US007874693B2

(12) United States Patent
Liao

(10) Patent No.: US 7,874,693 B2
(45) Date of Patent: Jan. 25, 2011

(54) CAP WITH ILLUMINATED REAR STRAP

(75) Inventor: Sung-Yie Liao, Taichung County (TW)

(73) Assignee: Chuan Cheng Hat Co., Ltd., Taichung (TW)

( * ) Notice: Subject to any disclaimer, the term of this patent is extended or adjusted under 35 U.S.C. 154(b) by 165 days.

(21) Appl. No.: 12/329,669

(22) Filed: Dec. 8, 2008

(65) Prior Publication Data

US 2010/0142191 A1 Jun. 10, 2010

(51) Int. Cl.
*F21V 21/084* (2006.01)
*F21V 7/04* (2006.01)
*F21L 4/00* (2006.01)

(52) U.S. Cl. ..... 362/106; 362/605; 362/570

(58) Field of Classification Search ..... 362/103, 362/105, 106, 570, 605, 618; 2/195.1, 195.2, 2/195.3, 195.4
See application file for complete search history.

(56) References Cited

U.S. PATENT DOCUMENTS 5,485,358 A * 1/1996 Chien ..... 362/106
6,499,145 B1 * 12/2002 Kates ..... 2/195.1
6,895,602 B2 * 5/2005 Schlapkohl ..... 2/209.13
7,052,154 B2 * 5/2006 Vanderschuit ..... 362/105
7,676,851 B2 * 3/2010 Koh ..... 2/246
2002/0108165 A1 * 8/2002 Porter et al. ..... 2/195.2
2006/0198122 A1 * 9/2006 Senter et al. ..... 362/105

* cited by examiner

*Primary Examiner*—Jong-Suk (James) Lee
*Assistant Examiner*—David R Crowe

(57) ABSTRACT

An illuminated cap in one embodiment includes a crown having a visor and a nonrigid arc member around a bottom edge of an inner surface of the crown. A light source assembly includes a circuit board, light emitting members connected to the circuit board, a switch connected to the circuit board, and at least one cell on the circuit board. A transparent member on a rear strap of the crown has a groove, with the light emitting members mounted therein. The transparent member is lit when the light emitting members are activated. A translucent member on an outer surface of the transparent member includes openings arranged as a predetermined shape. Emitted light is adapted to pass through the transparent member and to further pass through the openings to show the predetermined shape as a warning to rear incoming vehicles in the night.

6 Claims, 7 Drawing Sheets

CAP WITH ILLUMINATED REAR STRAP

BACKGROUND OF THE INVENTION

1. Field of Invention

The invention relates to caps and, more particularly, to a cap having an illuminated rear strap having a transparent member with light emitting members mounted thereon and a translucent member on an outer surface of the transparent member and comprising openings arranged as a predetermined shape. Emitted light may pass through the transparent member and the openings to show the predetermined shape as a warning to rear incoming vehicles in the night.

2. Description of Related Art

Conventionally, caps are widely used by people throughout the world. Some types of caps are even designed for specific purposes. Typically, a person may wear a cap as a decoration or to protect against precipitation or sunlight while walking in the street. There is a type of flashlight having a clip so that the flashlight can be secured to a cap visor and can illuminate the front. Thus, a person wearing a cap equipped with the flashlight may have both hands free to, for example, carry items while walking in the night.

However, the well known illuminated cap suffers from a number of disadvantages. For example, light is only directed to the front. Hence, for example, a careless driver may unintentionally have his or her speeding car hit a person wearing the illuminated cap since there is no light emitted rearward. This is not a safe design. Further, the cap has only an additional function of illumination. No flashing effect is provided. To the worse, its illumination is low, because its light emitting device is poor in performance. Thus, the need for improvement still exists.

SUMMARY OF THE INVENTION

It is therefore one object of the invention to provide a cap having an illuminated rear strap having a transparent member with light emitting members mounted thereon and a translucent member on an outer surface of the transparent member and comprising openings arranged as a predetermined shape. Emitted light may pass through the transparent member and the openings to show the predetermined shape as a warning to rear incoming vehicles in the night.

For achieving the above and other objects, an illuminated cap according to the invention includes a crown comprising and a forward visor. A first space defined by the crown the has a bottom opening, and a nonrigid arc member of predetermined width is disposed around a bottom edge of an inner surface of the crown. A second space is formed between the crown and the arc member when the arc member is pulled up. A light source assembly includes a circuit board, a plurality of light emitting members, a first cord interconnecting the circuit board and the light emitting members, a second cord extending from the circuit board, a switch at an open end of the second cord, and at least one cell releasably mounted on the circuit board. A transparent member disposed on a rear surface of the crown includes a lengthwise groove, with the light emitting members mounted therein. The transparent member is lit when the light emitting members are activated. A translucent member disposed on at least one portion of an outer surface of the transparent member includes a plurality of openings arranged as a predetermined shape. Light emitted by the light emitting members is adapted to pass through the transparent member and to further pass through the openings to show the predetermined shape.

The above and other objects, features and advantages of the invention will become apparent from the following detailed description taken with the accompanying drawings.

DETAILED DESCRIPTION OF THE INVENTION

Figure 1:
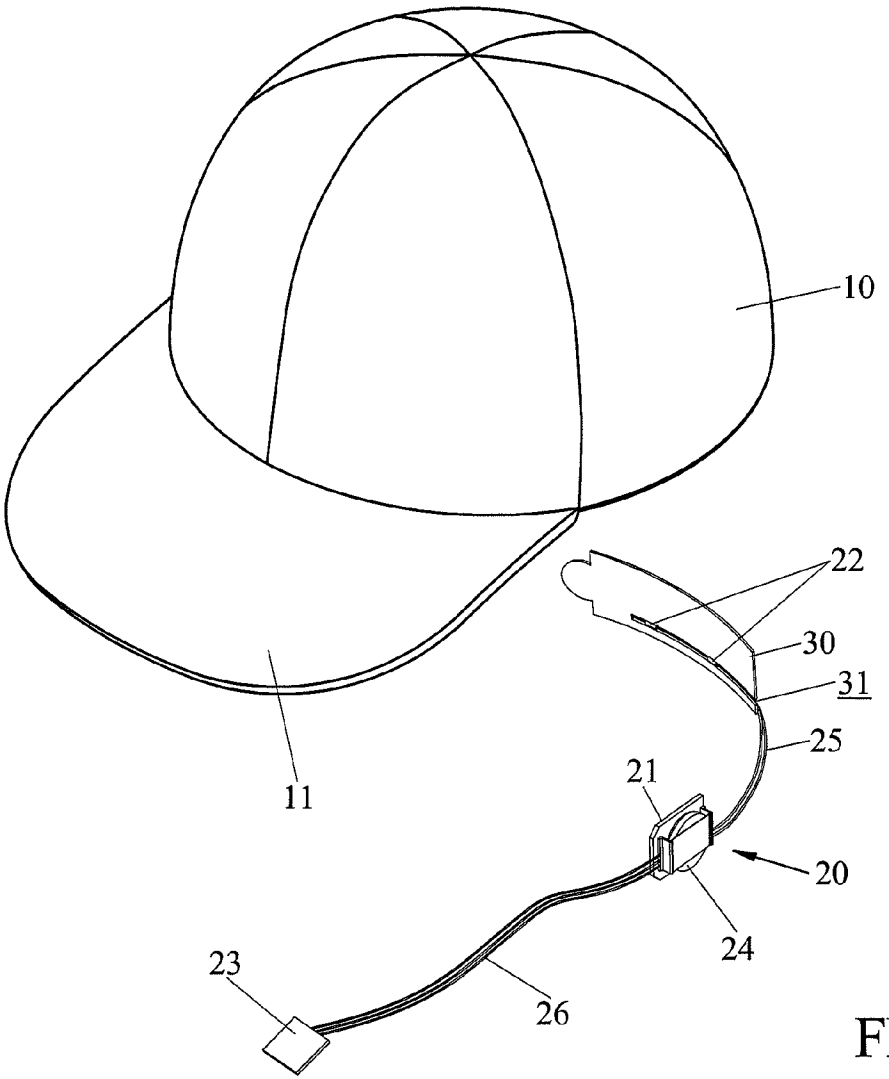
FIG. 1 is an exploded perspective view of a cap according to a first preferred embodiment of the invention.

Referring to FIGS. 1 to 4, a cap in accordance with a first preferred embodiment of the invention is shown. The cap comprises the following components each being discussed in detail below.

A crown 10 is made of fabric or synthetic fiber. The crown 10 has a forward visor 11. A space 12 is defined by the crown 10. The space 12 has a bottom opening 13. A nonrigid arc member 14 of predetermined width is provided around most of a bottom edge of an inner surface of the crown 10. A space 15 is formed between the crown 10 and the arc member 14 when the arc member 14 is pulled up. The crown 10 has a rear strap 16 bridging a rear recess (not numbered) thereof. A wearer may adjust the strap 16 to increase or decrease the size of the opening 13 so as to accommodate the cap to his or her head.

A light source assembly 20 comprises a circuit board 21, at least two light emitting member 22, a first cord 25 interconnecting the circuit board 21 and the light emitting members 22, a second cord 26 extending from the circuit board 21 in a direction opposite the first cord 25, a switch 23 at an open end of the second cord 26, and at least one cell (one is shown) 24 releasably mounted on the circuit board 21.

A transparent member 30 of substantially rectangular shape is provided. The transparent member 30 comprises a lengthwise groove 31 along the bottom edge, with the light emitting members 22 provided therein. Hence, the transparent member 30 may be lit when the light emitting members 22 are enabled.

Figure 2:
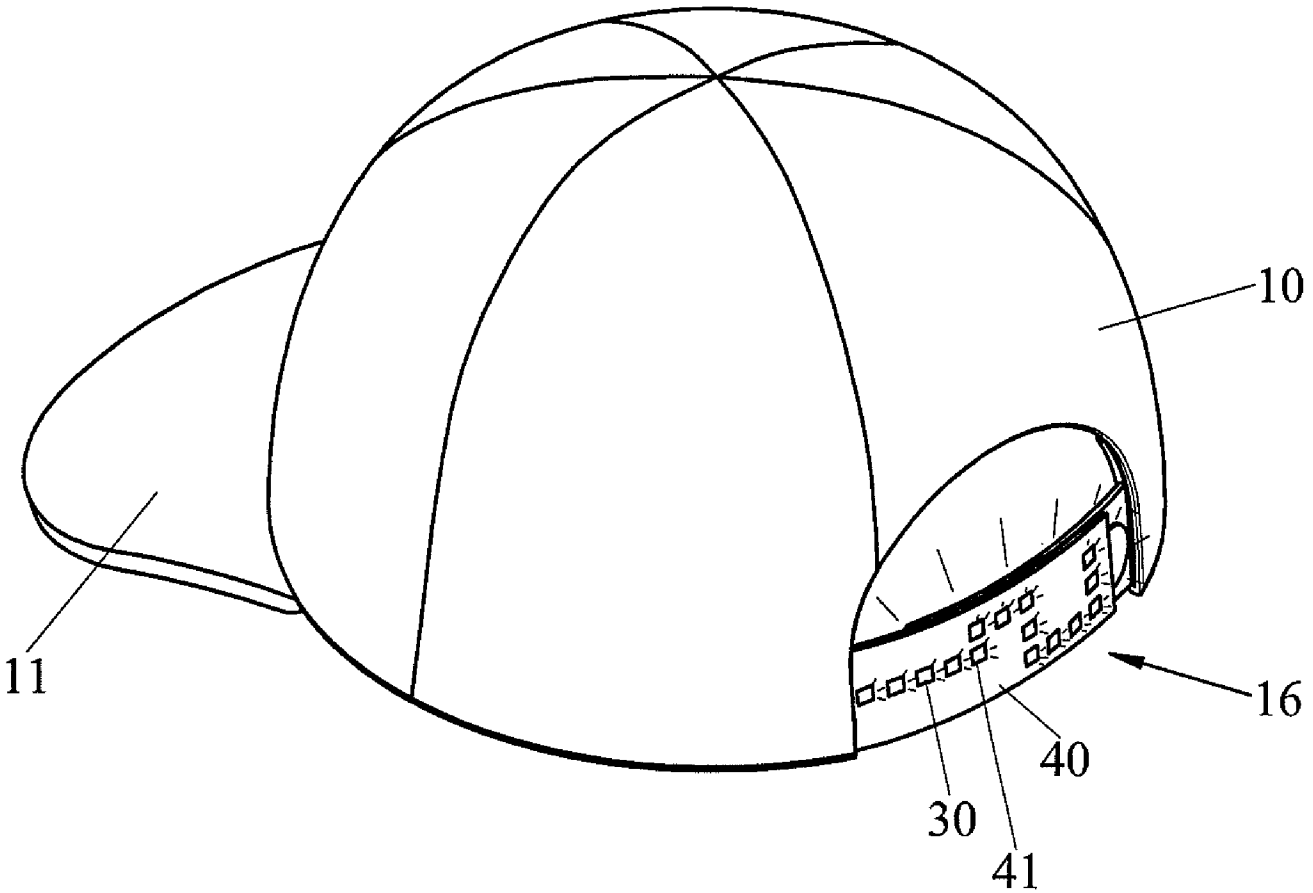
FIG. 2 is a perspective view of the assembled cap of FIG. 1 taken from the rear and where the strap is illuminated.
Figure 3:
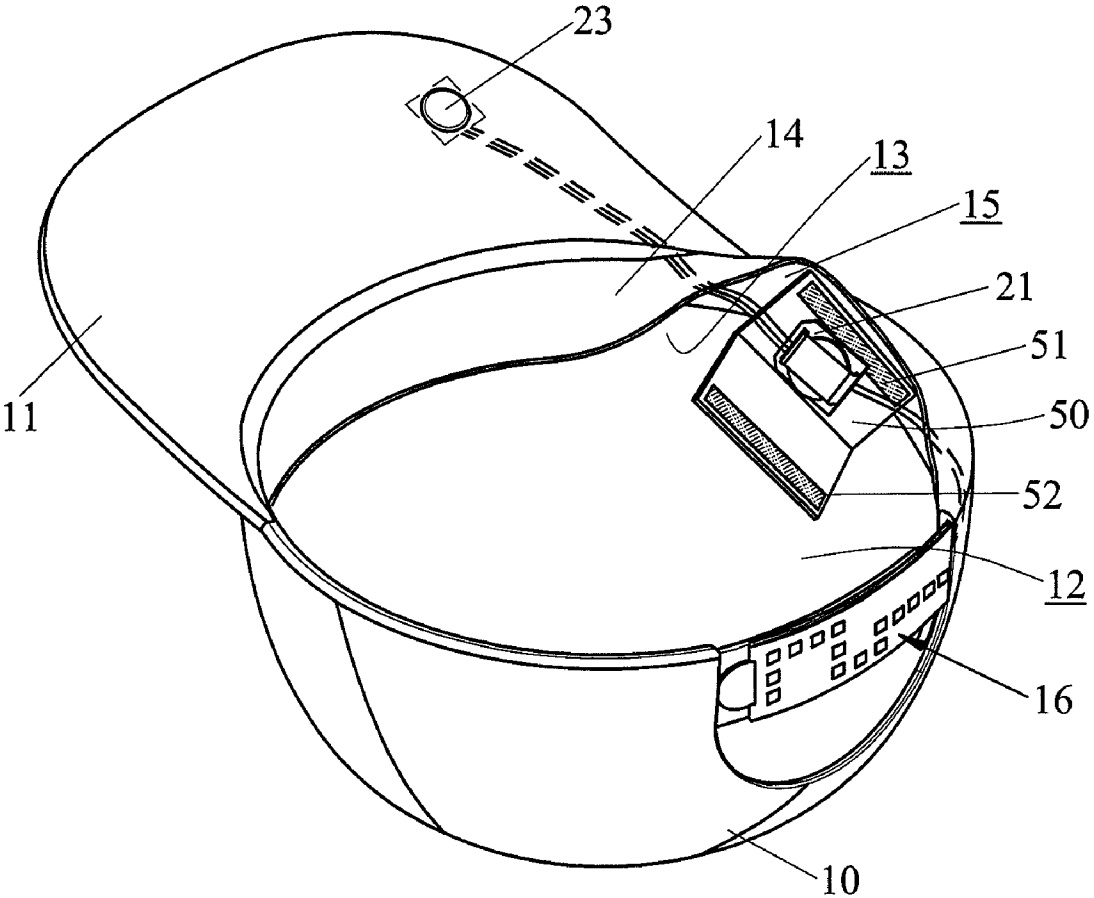
FIG. 3 is another perspective view of FIG. 2 taken from the bottom.
Figure 4:
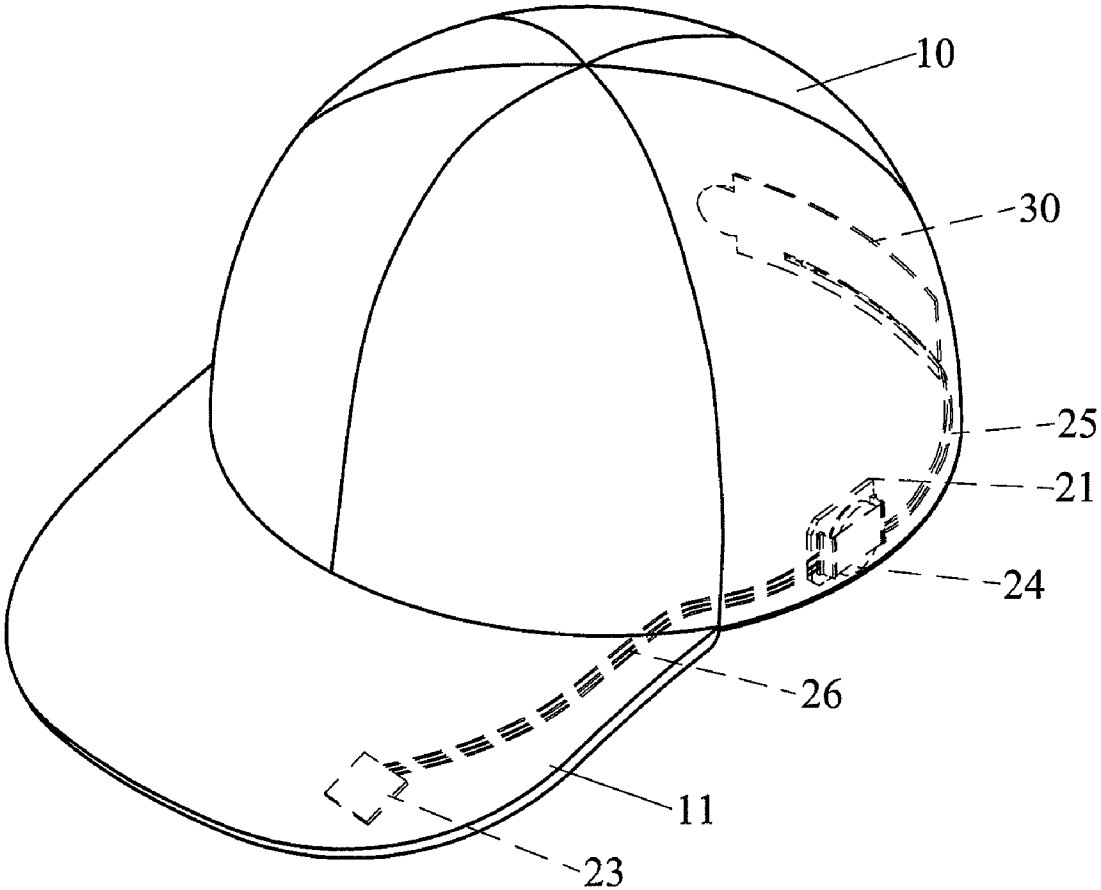
FIG. 4 is a further perspective view of FIG. 2 taken from the front.

A translucent member 40 is provided on an outer surface of the transparent member 30 (see FIG. 2). Alternatively, two or more translucent members 40 are provided on the outer surface of the transparent member 30. The translucent member 40 comprises a plurality of small openings 41 of rectangular shape. Emitted light passing through the transparent member 30 may further pass through the openings 41 to show a pattern of the specially arranged openings 41. Fol example, the openings 41 may be arranged as a logo, trademark, special pattern, or the like. The transparent member 30 is provided on an outer surface of the strap 16, and the translucent member 40 is also provided on the outer surface of the transparent member 30. Therefore, for example, a driver may clearly see the diffused image of, for example, a logo arranged by the openings 41 from a sufficient, long distance from the cap wearer in the night. Hence, the driver may, for example, slow down his or her car. This is a safe design. Moreover, the transparent member 30 (ie., the light emitting members 22) may flash rather than continuously light in another operating mode.

A pouch 50 is provided on both an inner surface of the arc member 14 and an inner surface of the crown 10. The pouch 50 is rectangular and has a first fabric hook and loop fastener 51 along one edge of an inner surface thereof and a second fabric hook and loop fastener 52 along the other opposite edge of the inner surface thereof. Each of the first fabric hook and loop fastener 51 and the second fabric hook and loop fastener 52 is a rectangle. The circuit board 21 is mounted in the pouch 50. Next, the first fabric hook and loop fastener 51 is pressed against the second fabric hook and loop fastener 52 to seal the pouch 50. In a storage state, the pouch 50 is sandwiched by the arc member 14 and the crown 10 and is hidden. Also, a person may pull the arc member 14 to see and then open the pouch 50.

The switch 23 is provided on the bottom surface of the visor 11. A person may press the switch 23 to activate the light emitting members 22 so that the light emitting members 22 may light, dim, or flash.

Figure 5:
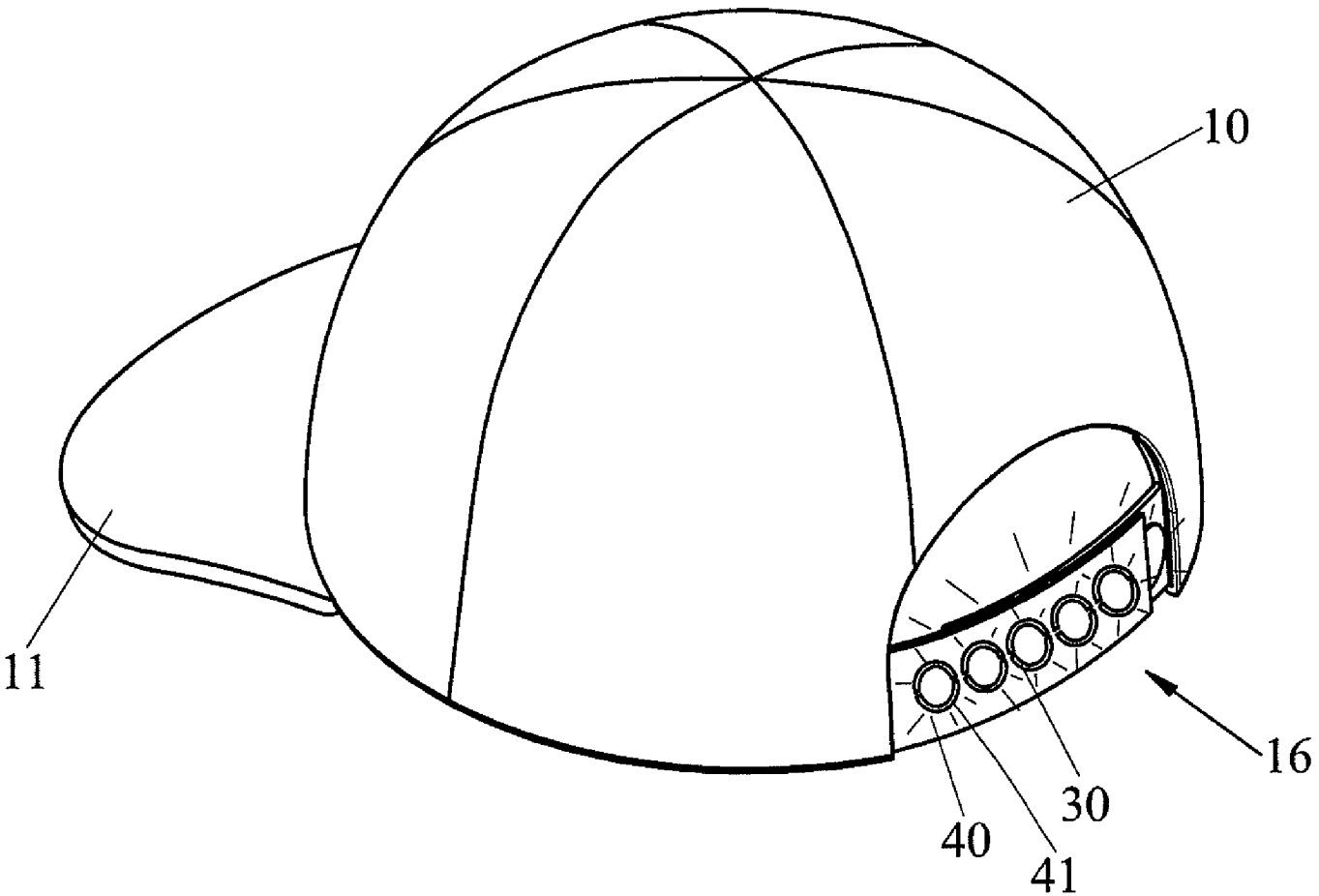
FIG. 5 is a perspective view of a cap according to a second preferred embodiment of the invention where the strap is illuminated.

Referring to FIG. 5, a cap according to a second preferred embodiment of the invention is shown. The cap comprises a crown 10 having a forward visor 11 and a rear strap 16. A transparent member 30 is provided on an outer surface of the strap 16. A translucent member 40 is provided on an outer surface of the transparent member 30. The translucent member 40 comprises a plurality of annular openings 41. Hence, emitted light may pass through the transparent member 30 and the openings 41. Therefore, for example, a driver may clearly see the diffused image of, for example, a pattern arranged by the openings 41 from a sufficient long distance from the cap wearer in the night. Hence, the driver may, for example, slow down his or her car. This is a safe design.

Figure 6:
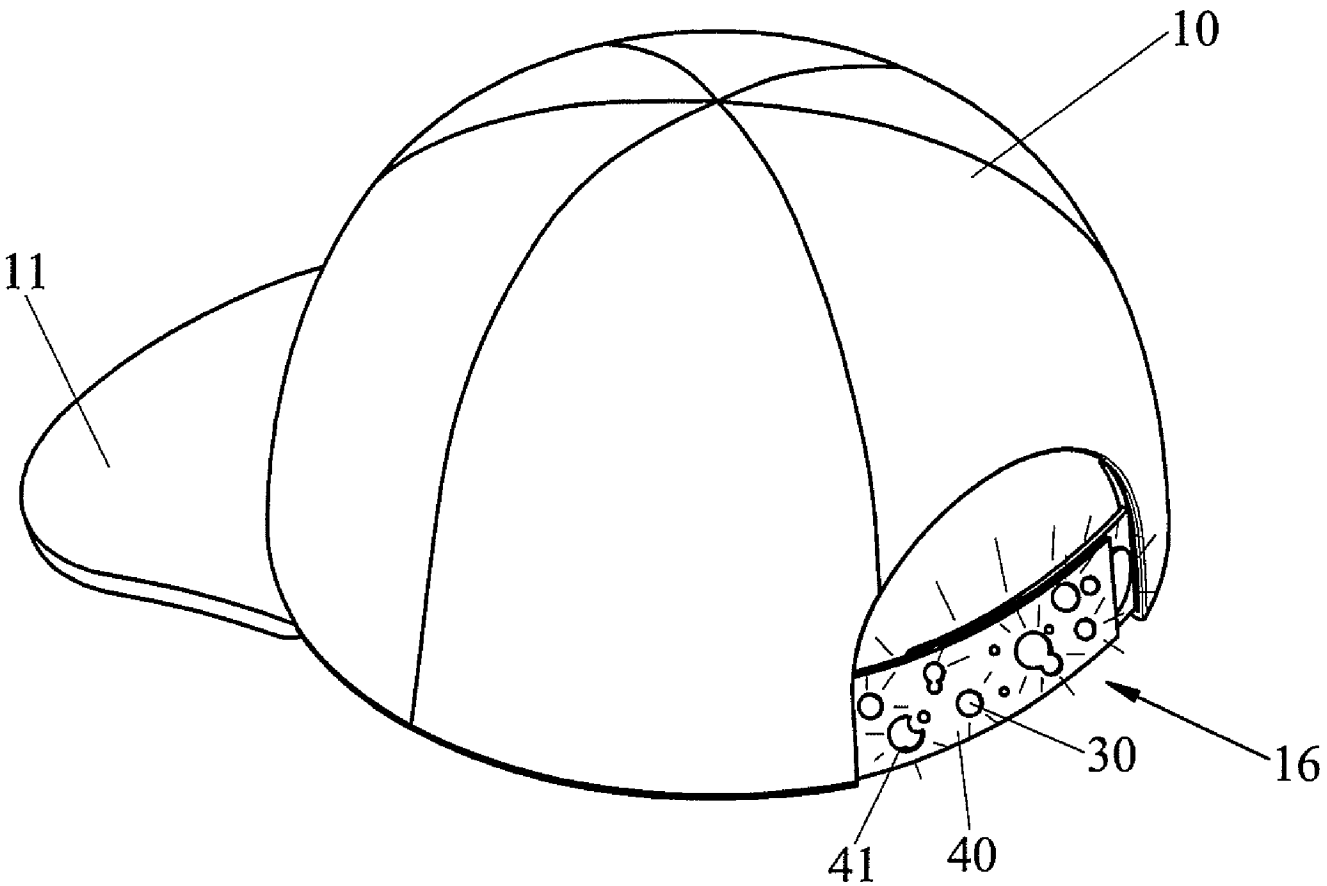
FIG. 6 is a perspective view of a cap according to a third preferred embodiment of the invention where the strap is illuminated.

Referring to FIG. 6, a cap according to a second preferred embodiment of the invention is shown. The cap comprises a crown 10 having a forward visor 11 and a rear strap 16. A transparent member 30 is provided on an outer surface of the strap 16. A translucent member 40 is provided on an outer surface of the transparent member 30. The translucent member 40 comprises a plurality of bubble shaped openings 41. Hence, emitted light may pass through the transparent member 30 and the openings 41. Therefore, for example, a driver may clearly see the diffused image of, for example, a pattern arranged by the openings 41 from a sufficient, long distance from the cap wearer in the night. Hence, the driver may, for example, slow down his or her car. This is a safe design.

Figure 7:
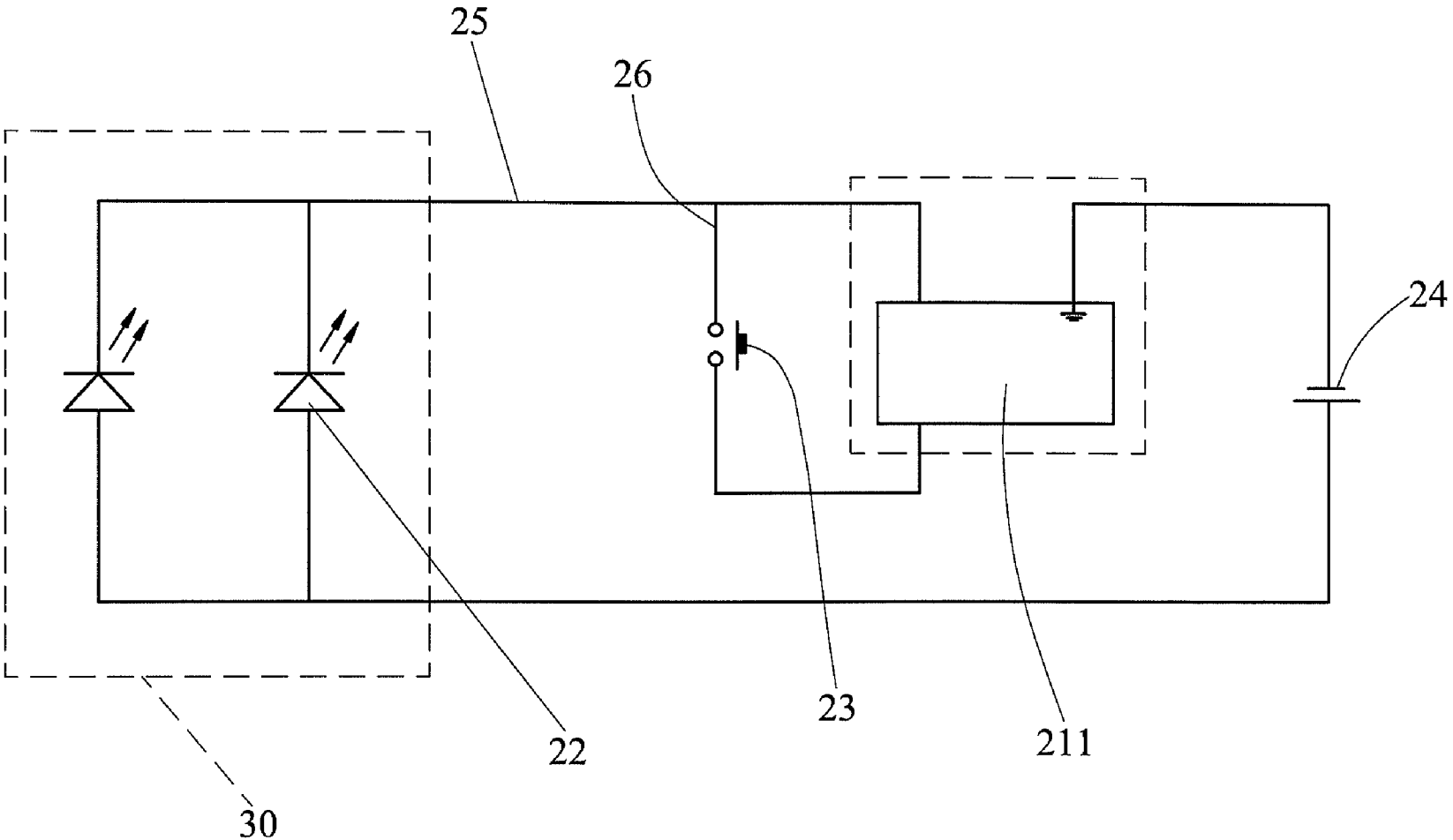
FIG. 7 is an electrical circuit diagram of the light source assembly according to the invention.

Referring to FIG. 7, a circuit diagram of the light source assembly is shown. The light source assembly comprises an IC (integrated circuit) 211, the switch 23, the light emitting members 22, and the cell 24. The switch 23 is electrically connected to the IC 211 via the first cord 25. The light emitting members 22 are electrically connected to the IC 211 via the second cord 26. A wearer may press the switch 23 to enable the light emitting members 22 to light, dim, or flash. Moreover, the transparent member 30 is provided to cover the light emitting members 22.

While the invention herein disclosed has been described by means of specific embodiments, numerous modifications and variations could be made thereto by those skilled in the art without departing from the scope and spirit of the invention set forth in the claims.

What is claimed is:

1. An illuminated cap comprising:

a crown having an inner surface defining a first space, with the crown having a bottom edge, with the first space having a bottom opening, with the crown having a rear recess extending from the bottom edge;

a non-rigid arc member of predetermined width disposed around the bottom edge of the inner surface of the crown and moveable between a first position abutting with the inner surface and a second position pulled up from the inner surface, wherein a second space is formed between the crown and the non-rigid arc member when the non-rigid arc member is in the second position;

a rear strap extending contiguous to the bottom edge and bridging the rear recess;

a visor extending from the bottom edge opposite to the rear recess;

a light source assembly comprising a circuit board, a plurality of light emitting members, a first cord interconnecting the circuit board and the light emitting members, a second cord extending from the circuit board, a switch at an open end of the second cord, and at least one cell releasably mounted on the circuit board, with the circuit board and the at least one cell located in the second space intermediate the visor and the rear recess, with the switch located on the visor;

a transparent member disposed on an outer surface of the rear strap, with the transparent member comprising a lengthwise groove with the light emitting members mounted therein, wherein the transparent member is lit when the light emitting members are activated; and a translucent member disposed on an outer surface of the transparent member, with the translucent member comprising a plurality of openings arranged as a predetermined shape, wherein light emitted by the light emitting members passes through the transparent member and further passes through the plurality of openings to show the predetermined shape.

2. The illuminated cap of claim 1, wherein the predetermined shape is a trademark.

3. The illuminated cap of claim 1, wherein the predetermined shape is a logo.

4. The illuminated cap of claim 1, wherein the predetermined shape is a pattern.

5. The illuminated cap of claim 1, wherein the crown is formed of fabric.

6. The illuminated cap of claim 1, wherein the crown is formed of synthetic fiber.

* * * * *